US006832395B1

(12) United States Patent
Jeffcoat

(10) Patent No.: US 6,832,395 B1
(45) Date of Patent: Dec. 21, 2004

(54) SWIMMING POOL COVER

(76) Inventor: Angela Marie Jeffcoat, 3716 Vale La., Philadelphia, PA (US) 19114

( * ) Notice: Subject to any disclaimer, the term of this patent is extended or adjusted under 35 U.S.C. 154(b) by 0 days.

(21) Appl. No.: 10/753,907

(22) Filed: Jan. 9, 2004

(51) Int. Cl.[7] ..... E04H 4/00
(52) U.S. Cl. ..... 4/498
(58) Field of Search ..... 4/498, 500, 503

(56) References Cited

U.S. PATENT DOCUMENTS 3,711,873 A 1/1973 Katzman
3,856,679 A 12/1974 Jackson
5,038,419 A 8/1991 MacDonald et al.
5,740,562 A 4/1998 Nickalo
6,286,156 B1 9/2001 Sullivan
6,691,334 B2 * 2/2004 St-Hilaire ..... 4/498

* cited by examiner

*Primary Examiner*—Tuan Nguyen
(74) *Attorney, Agent, or Firm*—Theresa M. Seal

(57) ABSTRACT

A swimming pool cover for preventing leaves and other debris from getting into the swimming pool, and which can be placed on the swimming pool and removed therefrom by one individual, includes a pliable mesh screen that covers the entire swimming pool, and the mesh screen includes a peripheral sleeve in which a flexible wiring is disposed for maintaining the disposition of the cover upon the pool. The swimming pool cover can be folded up and stored within a storage bag, and upon removal from the storage bag, the swimming pool cover opens up so that the individual can place the cover upon the swimming pool.

8 Claims, 3 Drawing Sheets

SWIMMING POOL COVER

FIELD OF THE INVENTION

The present invention pertains to swimming pool covers, and more particularly pertains to a swimming pool cover that can be placed on the swimming pool and removed therefrom by one individual.

BACKGROUND OF THE INVENTION

The popularity and ownership of private, residential swimming pools has risen dramatically in recent years as more and more homeowners have opted for the convenience, safety, ready availability and flexibility in use of both above ground and in ground swimming pools. As the popularity of residential swimming pools has increased, their cost has decreased, their range of design has increased, and numerous enhancements and accessories have also been made available.

The most general type of pool cover is the type that is placed over the pool when the swimming season is over and the pool needs protected from the harsh—winter—elements until the pool can be opened to commence the swimming season of the following year. The covers require some labor and effort in their deployment, and once they are placed above the pool and secured about the upper ledge and adjacent the pool sidewall, they remain on until the commencement of the next swimming season.

However, there is still the need to protect the pool during the swimming season when it is not in use so that leaves and other types of debris will not accumulate in the pool, marring the quality of the pool water and damaging the filtration equipment. The prior art discloses a number of pool covers that attempt to meet this need.

For example, the Katzman patent (U.S. Pat. No. 3,711,873) discloses a pool cover that includes a cover extended over a swimming pool, and which is maintained in position by water-filled tubes that are inserted into loops spaced about the cover periphery with the tubes located on the pool edge or deck.

The Jackson patent (U.S. Pat. No. 3,856,679) discloses a pool skimmer net that includes two uniquely designed arms, one of which is used for engaging and lifting the pool skimmer cover and the other one for engaging and lifting the strainer basket out of the skimmer.

The MacDonald et al. patent (U.S. Pat. No. 5,038,419) discloses a pool cover draining device that includes an opening formed in a portion of the pool cover to allow water that has collected thereon to drain into the pool. A mesh bag is disposed beneath the opening to prevent debris from draining into the pool.

The Nickalo patent (U.S. Pat. No. 5,740,562) discloses a pool protector device that includes a plurality of interlocking panels that span the swimming pool for preventing external access to the swimming pool water.

The Sullivan patent (U.S. Pat. No. 6,286,156 B1) discloses a swimming pool cover that includes a foldable plastic frame that supports a mesh screen that folds and unfolds with the frame for placement over the swimming pool.

Nonetheless, despite the ingenuity of the above devices, their remains a need for a swimming pool cover that is lightweight, flexible, and, most significantly, can be deployed for use on the swimming pool, and removed therefrom, by only one individual.

SUMMARY OF THE INVENTION

The present invention comprehends a swimming pool cover for keeping leaves and other debris out of the swimming and that can be placed on the swimming pool, and removed therefrom, by one individual. The swimming pool cover includes a flexible mesh screen having a peripheral sleeve in which a flexible wiring is disposed. In addition, the peripheral sleeve includes slots through which drawstrings extend so that the drawstrings can be pulled and tied by the individual for tightening and securing the swimming pool cover to the swimming pool. The swimming pool cover can be stored within a storage bag so that upon removal from the storage bag, the swimming pool cover pops open so that one individual can easily maneuver and place the swimming pool cover on the swimming pool.

It is an objective of the present invention to provide a swimming pool cover that can be disposed on the swimming pool and removed therefrom by one individual.

It is another objective of the present invention to provide a swimming pool cover that can be collapsed for placement in a storage bag.

It is still another objective of the present invention to provide a lightweight and portable swimming pool cover that can be easily stored and transported.

It is still yet another objective of the present invention to provide a swimming pool cover that opens on its own when removed from the storage bag so that the swimming pool cover can be placed on the swimming pool.

Yet another objective of the present invention is to provide a swimming pool cover that includes features integral with the swimming pool cover that allow for the securement of the swimming pool cover to the swimming pool.

These and other objects, features, and advantages will become apparent upon a perusal of the following detailed description read in conjunction with the accompanying drawing figures.

DETAILED DESCRIPTION OF THE PREFERRED EMBODIMENT

Figure 1:
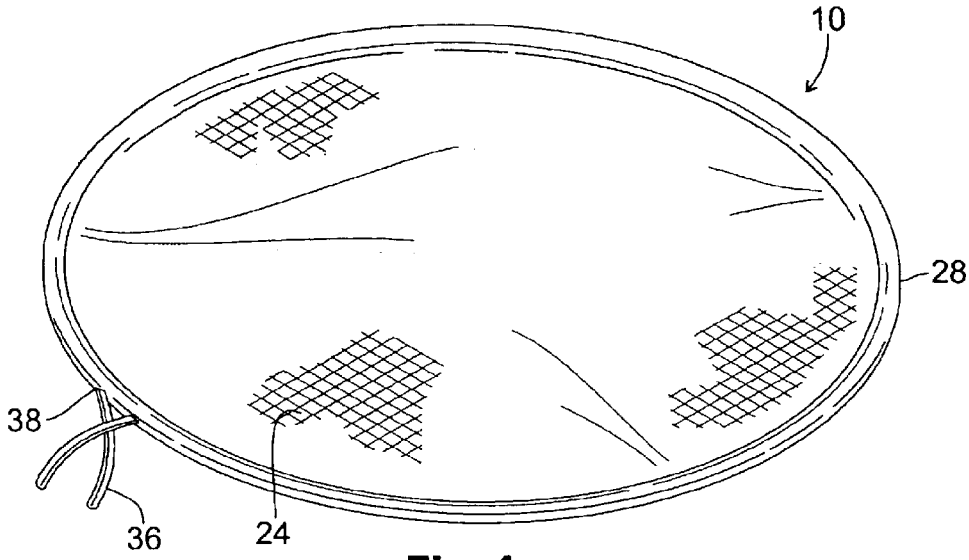
FIG. 1 is a perspective view of the swimming pool cover of the present invention.

Illustrated in FIGS. 1–6 is a swimming pool cover 10 for placement on a swimming pool 12 in order to prevent leaves and other debris from getting into the swimming pool 12 marring the quality of the pool water 14 and clogging the pool skimmer and filtration apparatus 16. The pool cover 10 of the present invention is especially suited for use by just one individual for deploying the pool cover 10 on the swimming pool 12 and removing the pool cover 10 therefrom for storage.

The swimming pool cover 10 of the present invention can be used with both above ground and in ground swimming pools, and, in general, the above ground swimming pool 12 will include a sidewall 18 for containing the pool water 14, an upper ledge 20 extending along the sidewall 18 for securing the lining to the sidewall 18, and a deck 22 for providing access to the pool 12 and a shelter for the filtration equipment 16.

Figure 2:
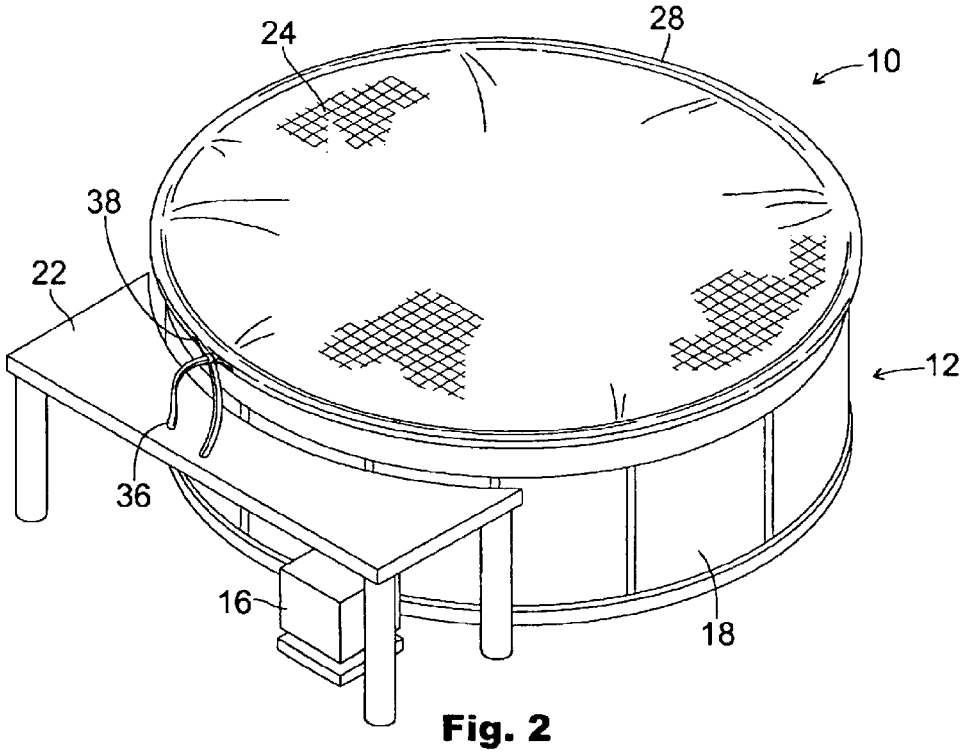
FIG. 2 is a perspective view of the swimming pool cover of the present invention illustrating the placement of the swimming pool cover on the swimming pool.
Figure 3:
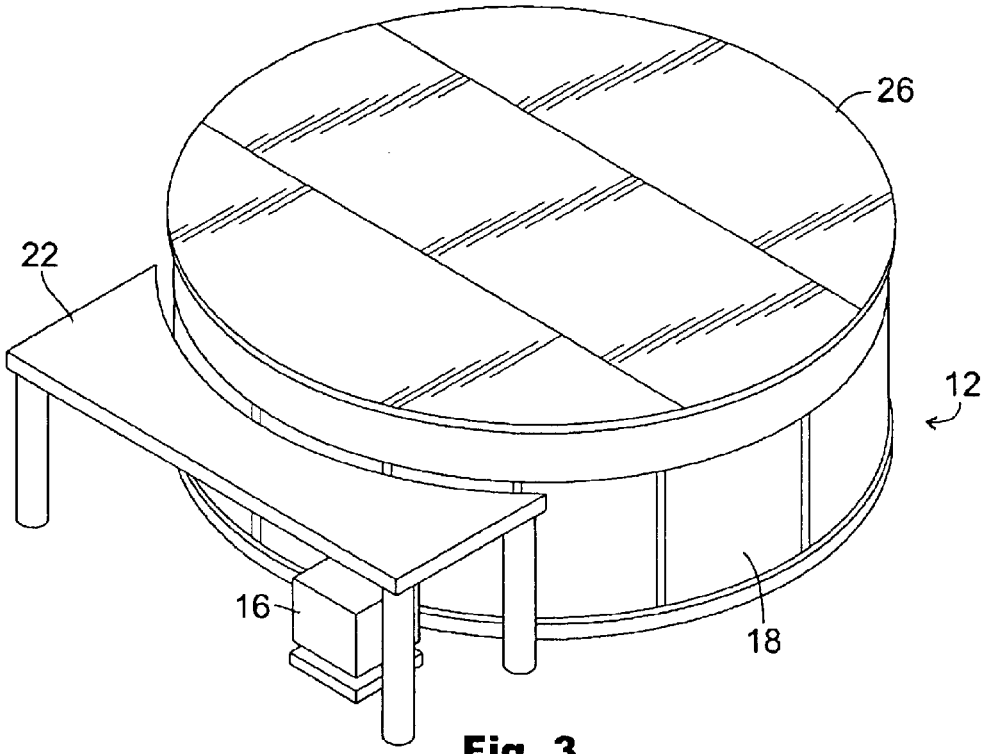
FIG. 3 is a perspective view of an alternative embodiment illustrating a hard cover, non-permeable swimming pool cover disposed on a swimming pool.

As shown in FIGS. 1–6, the swimming pool cover 10 includes a flexible mesh screen 24 that can be collapsed and folded to a non-use position and popped open to the use position. The mesh screen 24 can be sized to span and extend across the various types of swimming pools available, and the mesh screen 24 can come in a variety of configurations with circular being the preferable configuration. The mesh screen 24 prevents leaves and other kinds of debris from getting into the swimming pool 12 and impairing the quality of the pool water 14 and the operation of the filtration equipment 16. While a pool cover 10 having a mesh screen 24 is the preferred type of screen, FIG. 3 illustrates a solid, lightweight pool cover 26 that can be securely placed on the swimming pool 12 for completely closing off the swimming pool 12.

Figure 4:
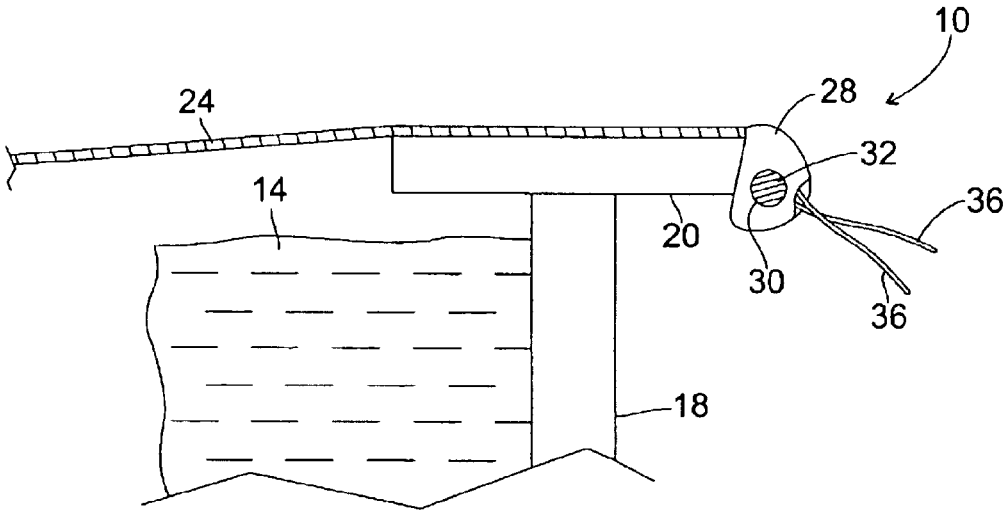
FIG. 4 is a sectioned elevational view of the swimming pool cover of the present invention illustrating the enclosure of the flexible wiring by the peripheral sleeve of the swimming pool cover.
Figure 5:
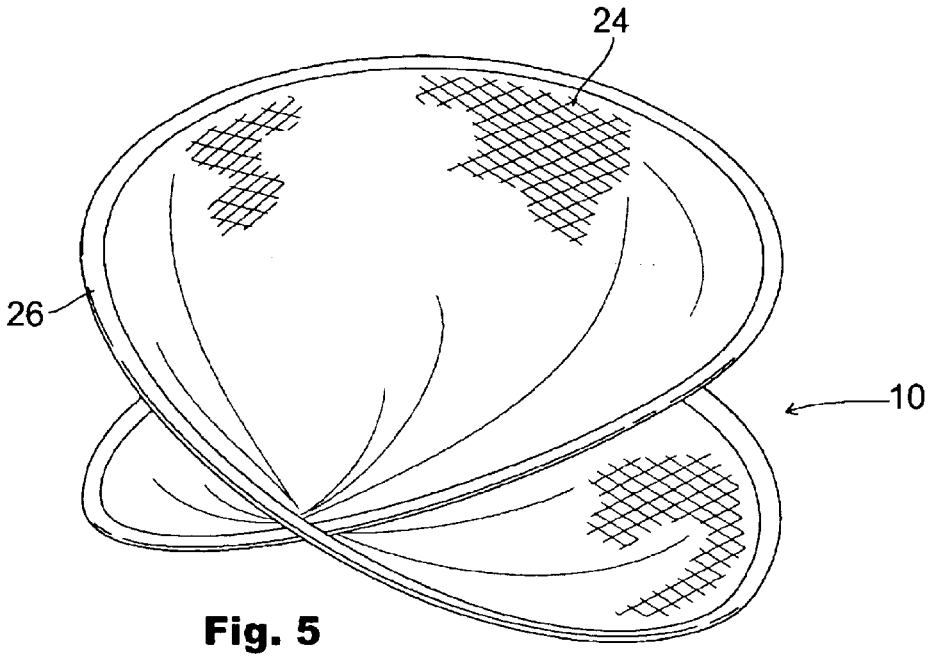
FIG. 5 is a perspective view of the swimming pool cover of the present invention illustrating the opening of the swimming pool cover for placement on the swimming pool.
Figure 6:
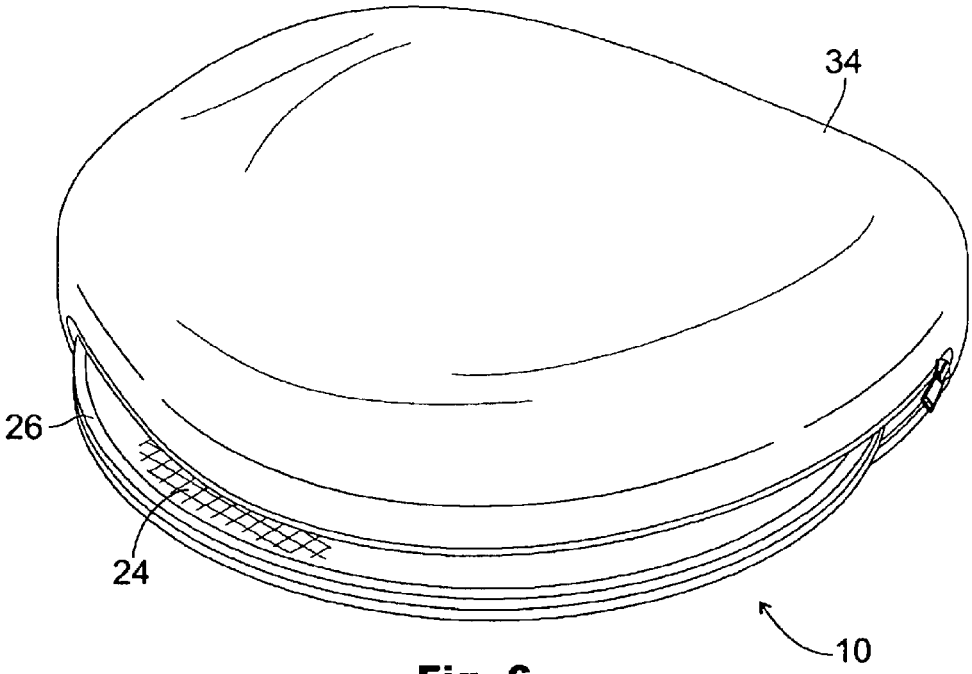
FIG. 6 is a perspective view of the swimming pool cover of the present invention illustrating the placement of the swimming pool cover in a storage bag.

As shown in FIGS. 1–6, the mesh screen 24 includes a peripheral sleeve 28 that is integrally formed to the mesh screen 24. The sleeve 28 includes a passageway 30 that is coextensive with the sleeve 28, and disposed in the passageway 30 is a flexible support member 32 that is preferably metal wiring. The support member 32 can be compactly folded and collapsed for storage in a storage bag 34, as shown in FIGS. 5 and 6, and when the support member 32 is removed from the storage bag 34, it pops open and unfolds to the use position, as shown in FIGS. 1 and 2, for placement on the swimming pool 12. Thus, the pool cover 10 can be collapsed and stored inside the storage bag 34 when not in use, and then quickly and easily taken out of the bag 34 whereupon the support member 32 unfolds and opens up. The unfolding of the support member 32 causes the mesh screen 24 to also unfold and open up for placement on the swimming pool 12.

As shown in FIGS. 1, 2 and 4, in order to tightly secure the swimming pool cover 10 to the swimming pool 12, a pair of drawstrings 36 project outwardly from a slot 38 formed on the sleeve 28. After the placement of the swimming pool cover 10 upon the swimming pool 12, the drawstrings 36 would be pulled together to tighten the cover 10 on the swimming pool 12, and then the drawstrings 28 would be tied or connected together to keep the mesh screen 24 in position.

With reference to FIGS. 1–6, in order to use the swimming pool cover 10, the individual would first remove the cover 10 from the storage bag 34. Upon removal from the storage bag 34, the pool cover 10 quickly pops open and unfolds as the flexible support member 32 opens to the circular configuration with the mesh screen 24 following. Several shakes may be required to initiate the unfolding if the support member 32 does not immediately open up. The individual then positions the pool cover 10 above the pool 12, and then places the fully open pool cover 10 upon the swimming pool 12 tightening the drawstrings 36 to securely fasten the pool cover 10 to the swimming pool 12. When it is desired to use the pool 12, the individual simply lifts the lightweight cover 10 off the pool, shakes the leaves and debris from the mesh screen 24, and then carefully collapses the pool cover 10 down to size so that the pool cover 10 fits within the storage bag 34 whereupon the pool cover 10 is ready for the next use.

While preferred embodiments of the invention have been set forth above, it is to be understood that numerous modifications, alterations, and variations may be made which nevertheless are within the scope and spirit of the invention as set forth in the appended claims.

I claim:

1. A swimming pool cover for covering a swimming pool so that leaves and other debris are prevented from getting into the swimming pool, comprising:

a pliable and foldable mesh screen for disposition on the swimming pool for preventing leaves and other debris from getting into the swimming pool;

the mesh screen including a peripheral sleeve that is disposed adjacent the upper edge of the swimming pool when the mesh screen is placed on the swimming pool;

a flexible and collapsible support member extending within the sleeve and capable of maintaining the disposition of the mesh screen across and above the swimming pool when the mesh screen is placed on the swimming pool; and a storage bag for receiving and storing therein the mesh screen so that removal of the mesh screen from the storage bag allows the support member to open up to a circular configuration thereby unfolding the mesh screen so that the mesh screen can be placed on the swimming pool.

2. The swimming pool cover of claim 1 wherein the support member is a flexible and collapsible metal wire.

3. The swimming pool cover of claim 2 wherein the sleeve includes at least one slot formed thereon.

4. The swimming pool cover of claim 3 wherein a pair of drawstrings extend outwardly from the slot so that after the swimming pool cover is placed on the swimming pool, the drawstrings can be manually tightened and interconnected for securing the swimming pool cover to the swimming pool.

5. The swimming pool cover of claim 4 wherein the unfolding of the support member causes the concomitant unfolding of the mesh screen to the circular configuration.

6. A swimming pool cover for covering a swimming pool so that leaves and debris are prevented from getting into the swimming pool, comprising:

a flexible and collapsible mesh screen for covering the swimming pool so that leaves and debris are prevented from getting into the swimming pool;

the mesh screen including a peripheral sleeve that is disposed adjacent the upper edge of the swimming pool when the mesh screen is placed on the swimming pool;

a pliable and collapsible support member extending within the sleeve for maintaining the circular configuration of the mesh screen above and across the swimming pool when the mesh screen is placed on the swimming pool;

a storage bag for storing therein the swimming pool cover so that the removal of the swimming pool cover allows the support member to unfold and thus open the mesh screen to the circular configuration whereupon the swimming pool cover can be placed on the swimming pool; and and a pair of drawstrings extending outwardly from the sleeve so that after the swimming pool cover is placed on the swimming pool, the drawstrings can be manually tightened and connected thereby securing the swimming pool cover to the swimming pool.

7. The swimming pool cover of claim 6 wherein the support member is metal wiring.

8. The swimming pool cover of claim 7 wherein the removal of the pool cover from the storage bag allows the support member to unfold to the circular configuration thereby causing the concomitant unfolding of the mesh screen to the circular configuration so that the pool cover can be placed on the swimming pool.

* * * * *